US010994906B2

(12) United States Patent
Chmelar

(10) Patent No.: US 10,994,906 B2
(45) Date of Patent: May 4, 2021

(54) EASY-TO-REMOVE CABLE TIE

(71) Applicant: Erik Vaclav Chmelar, Midland, MI (US)

(72) Inventor: Erik Vaclav Chmelar, Midland, MI (US)

( * ) Notice: Subject to any disclaimer, the term of this patent is extended or adjusted under 35 U.S.C. 154(b) by 0 days.

(21) Appl. No.: 16/167,396

(22) Filed: Oct. 22, 2018

(65) Prior Publication Data

US 2019/0119018 A1 Apr. 25, 2019

Related U.S. Application Data

(60) Provisional application No. 62/575,881, filed on Oct. 23, 2017.

(51) Int. Cl.
*B65D 63/10* (2006.01)

(52) U.S. Cl.
CPC ..... *B65D 63/1027* (2013.01); *B65D 63/1072* (2013.01); *B65D 2563/108* (2013.01)

(58) Field of Classification Search
CPC ..... B65D 63/1027; B65D 63/1072; B65D 2563/108; Y10T 24/1498
See application file for complete search history.

(56) References Cited

U.S. PATENT DOCUMENTS 3,206,814 A 9/1965 Schumm
3,731,347 A 5/1973 Caveney et al.
4,191,334 A 3/1980 Bulanda et al.
5,123,686 A * 6/1992 Wenk ..... B65D 63/1072 24/16 PB
5,395,343 A 3/1995 Iscovich
5,766,218 A * 6/1998 Arnott ..... A61B 17/823 24/16 PB
5,802,888 A * 9/1998 Parsons ..... A61F 5/37 128/879
5,881,435 A 3/1999 Jermyn
5,964,013 A 10/1999 Bergstrom
6,151,761 A * 11/2000 Thompson ..... E05B 75/00 24/16 PB
6,196,033 B1 * 3/2001 Dowdle ..... E05B 75/00 24/16 PB
6,276,031 B1 * 8/2001 Haiduk ..... B62J 7/08 24/16 PB
6,355,887 B1 * 3/2002 Gretz ..... F16L 3/233 174/135
7,062,820 B1 6/2006 Oestreich
7,131,168 B2 * 11/2006 Pangallo ..... B65D 63/1063 24/16 PB
7,281,302 B2 10/2007 Hewes
7,360,281 B1 4/2008 MacCartey et al.
D634,187 S * 3/2011 Kozel ..... D8/396
8,231,626 B2 7/2012 Hulliger et al.
(Continued)

*Primary Examiner* — Robert Sandy
*Assistant Examiner* — Louis A Mercado
(74) *Attorney, Agent, or Firm* — Erik Chmelar

(57) ABSTRACT

A cable tie having a locking head, a strap, and a truss projecting from the plane of the strap separated from the head by a slot. The strap may be passed over the truss, fed through the slot, and rested upon the truss to form a loop having a cavity therein. The strap may be subsequently passed around an object and fed into the head to lock the cable tie. A cutting implement may be inserted into the cavity to cut the loop and thereby release the cable tie from the object.

20 Claims, 13 Drawing Sheets

(56) References Cited

U.S. PATENT DOCUMENTS

| | | | | |
|---|---|---|---|---|
| 8,595,904 | B2 | 12/2013 | Klementowicz et al. | |
| 8,739,387 | B1 * | 6/2014 | Frishberg | F16L 3/2332 140/93 A |
| 9,047,788 | B2 * | 6/2015 | Koh | G09F 3/037 |
| 9,266,654 | B1 | 2/2016 | Scott et al. | |
| 9,611,083 | B2 | 4/2017 | Schuttler et al. | |
| 9,630,758 | B2 * | 4/2017 | Kozminske | B65D 63/1027 |
| 9,643,764 | B1 * | 5/2017 | Huang | B65D 63/1072 |
| 9,725,220 | B2 | 8/2017 | Dietrich | |
| D835,495 | S * | 12/2018 | Votel | D8/356 |
| 2011/0131768 | A1 | 6/2011 | Watson | |
| 2017/0113857 | A1 | 4/2017 | Berglund | |

* cited by examiner

EASY-TO-REMOVE CABLE TIE

CROSS-REFERENCE TO RELATED APPLICATIONS

This application is claims the benefit of provisional U.S. Pat. App. 62/575,881, filed Oct. 23, 2017. The disclosure of the prior application is incorporated herein by reference.

BACKGROUND OF THE INVENTION

The present invention relates to cable ties for tying, bundling, securing, marking, or tagging objects. For simplicity, the term "bundling" may be used to indicate any of the above or similar functions of a cable tie and the term "bundled object" may be used to indicate an object or objects to which a cable tie is secured. Additionally, the present invention relates to restraining devices such as handcuffs for tying together or restricting the motion of human wrists (hands) or legs (feet). Although the majority of illustrations of this disclosure depict cable ties that bundle objects, they apply equally to handcuff restraining devices. Cable ties are sometimes called zip ties, wire ties, tie wraps, and wire ties. Cable ties may be made of a variety of materials, for example plastic (e.g., polyamide such as Nylon 6/6) or metal (e.g., stainless steel such as AISI 304 or 314).

A cable tie generally comprises a head and an elongated strap. The head includes a channel to receive the strap so that the cable tie may form a closed loop around an object or some portion thereof. The channel includes a means to engage the strap, and may include a ratcheting mechanism so that the strap may move easily through the channel in one direction (insertion) but may not move easily in the opposite direction (withdrawal). A common means to engage the strap is a toothed pawl that mates with a serrated surface of the strap. Another means to engage the strap is a ball that becomes wedged between a smooth surface of the strap and an angled surface of the channel. For simplicity, the means to engage the strap will hereafter be referred to as a pawl regardless of the actual mechanism, regardless of whether the pawl performs a ratcheting function, and regardless of whether the strap includes a serrated surface or surfaces.

Cable ties may be secured to objects temporarily. Consequently, some cable ties are designed to be releasable and/or reusable by having a means to disengage the pawl and remove the cable tie from an object. However, existing methods for disengaging the pawl may be inconvenient or impractical. Further, reusable cable ties tend to be more expensive to produce than single-use cable ties. As a result, a majority of cable ties are designed for single use (e.g., disposable).

Removing a single-use cable tie may require a user to cut the strap with a cutting implement, for example snip pliers, electric pliers, cable cutters, shears, scissors, or knives. But it may be difficult to insert a cutting implement between the strap and a bundled object, and doing so may damage the object. Several methods are described below that attempt to aid in cutting of a cable tie, such as a cable tie having an integrated cutting blade or a cable tie having a supplemental arch that may be more easily accessed by a cutting implement.

U.S. Pat. No. 7,360,281 discloses a cable tie having a housing disposed on the strap that includes a pair of blades adjacent to the strap. When a user rotates or depresses the housing, the blades compress and cut through the strap.

U.S. Pat. No. 5,395,343 discloses a tie for anchoring medical tubing wherein the strap includes a region that arches away from the medical tubing to permit scissors to be inserted between the arched region and the tubing to cut the strap. This feature may be unsuitable for some applications because the unsupported arch may collapse when the tie is tightened. A winning entry of the 2012 RED DOT Concept Design Award was a cable tie designed to prevent total collapsing of an arch by forming the arch as tapering from a first height at a first edge of the strap to zero height at the opposite edge of the strap.

U.S. Pat. No. 5,964,013 discloses a cable tie having a flap that may be folded over the head and engaged with an arched spring region of the strap which compresses during bundling. When the flap is cut, the arched spring becomes uncompressed and thereby creates a space between the strap and a bundled object for inserting a cutting implement to remove the cable tie from the object.

Instead of enabling easier cutting of a cable tie, several methods have been developed that permit the cable tie to be torn apart by hand. A few references follow.

European Patent 398,562 discloses a tie that serves a security seal, which has a pull tab that causes a thinned region of one or both side walls of the head to tear open when pulled, thereby releasing the tie from a bundled object.

U.S. Pat. No. 7,281,302 discloses a cable tie having a pull tab that causes a thinned region of a side wall of the head to tear open when pulled, thereby releasing the tie from a bundled object.

U.S. Pat. No. 7,062,820 discloses a cable tie that serves as a tote box lid retainer, which has a pull tab that causes a thinned region of the strap adjacent to the head to tear apart when pulled, thereby releasing the tie from a bundled object.

U.S. Pat. No. 5,881,435 discloses a cable tie having a thinned region running the longitudinal length of the upper wall of the head adjacent to the channel which may tear open when the strap within the channel is forced upwards against the upper wall and away from a bundled object.

Instead of cutting or tearing a cable tie, it is possible to design cable tie in such a way that the pawl may disengage, thereby permitting the strap to be withdrawn from the channel. A reference follows.

U.S. Pat. No. 9,266,654 discloses a cable tie having two channels in the head, a first channel having a pawl that does not permit withdrawal of the strap and a second channel having a pawl that permits withdrawal of the strap by means of a lever extending from the pawl that causes the pawl to disengage when actuated with a finger.

Many of the previously described methods have limitations. For example, cable ties having integrating blades tend to be expensive to manufacture. Cable ties having thinned regions for tearing tend to be weaker than equivalent standard cable ties. Finally, cable ties having pawls with levers that can be pressed to disengage the pawl tend to be difficult to disengage.

BRIEF SUMMARY OF THE INVENTION

The several embodiments within this disclosure teach a cable tie and a method for using a cable tie that addresses limitations of standard cable ties and of cable ties adapted to be more easily removed from an object. The several embodiments disclose a cable tie having a truss or arch on or around which the strap may be looped so that the strap is maintained away from an object that the cable tie is secured to. The truss or arch creates a cavity into which a cutting implement may be inserted, therefore making it easier to cut the strap and remove the cable tie from the object. Cutting implements may include a pair of snip pliers, diagonal pliers, lineman's pliers, pincers, electric pliers, wire cutters, crimpers, scissors, shears, nippers, and so on. The cutting edge of such tools may be referred to as the "blade."

In one embodiment the cable tie comprises a head on one end of the strap and a truss on a medial portion of the strap. The truss may be adjacent to a slot that separates the truss from the head (the slot may be adjacent to the head but it need not be). In one embodiment, the distal end of the strap may be passed over the truss, inserted into the slot, and pulled through the slot until a surface of the strap overlaps the truss, thereby forming a first loop. Although the remainder of the strap is capable of passing through the slot, it is prevented from doing so by the truss. Moreover, the first loop is prevented from collapsing onto itself because the truss around which the first loop is formed has sufficient structural integrity. Therefore, this first loop may have a region of the strap that is always separated from an object by a cavity within the truss.

In one embodiment, to secure the cable tie to an object, the distal end of the strap is passed around the object, inserted into a channel of head, and pulled through the channel to engage the strap with a pawl. To remove the cable tie from the object, a cutting implement may be inserted into the cavity beneath the truss and within the first loop, and used to cut through the first loop. The region of the strap that was maintained away from the slot by the truss may now be moved through and out of the slot, thereby releasing the cable tie from the object.

DETAILED DESCRIPTION OF THE INVENTION

The following numerals are used to identify the corresponding elements in the figures for the several embodiments. 200-level numbers refer to elements on or associated with the head; 300-level numbers refer to elements on or associated with the strap; 400-level numbers refer to elements on or associated with the slot; 500-level numbers refer to elements on or associated with the truss.

| | |
|---|---|
| 100 | cable tie |
| 200, 200a, 200b | head |
| 210, 210a, 210b | channel |
| 220, 220a, 220b | pawl |
| 300, 300a, 300b | strap |
| 310, 310a, 310b | serrations |
| 320, 320a, 320b | corrugations |
| 330, 330a, 330b | bulge |
| 340, 340a, 340b | bumper |
| 400, 400a, 400b | slot |
| 410 | nub |
| 420 | aperture |
| 500, 500a, 500b | truss |
| 510, 510a, 510b | cavity |
| 520, 520a, 520b | void |

Figure 1A:
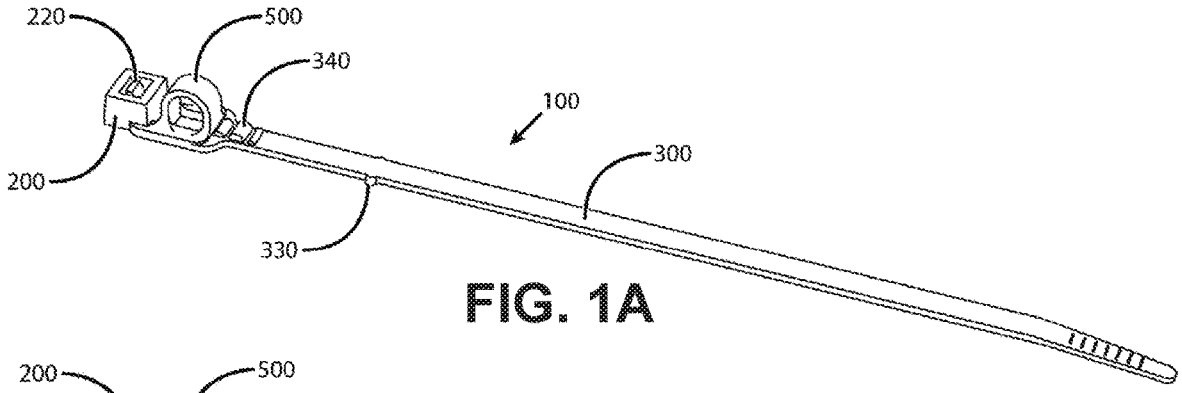
FIGS. 1A-1B show top and bottom perspective views of a first embodiment, respectively.
Figure 1B:
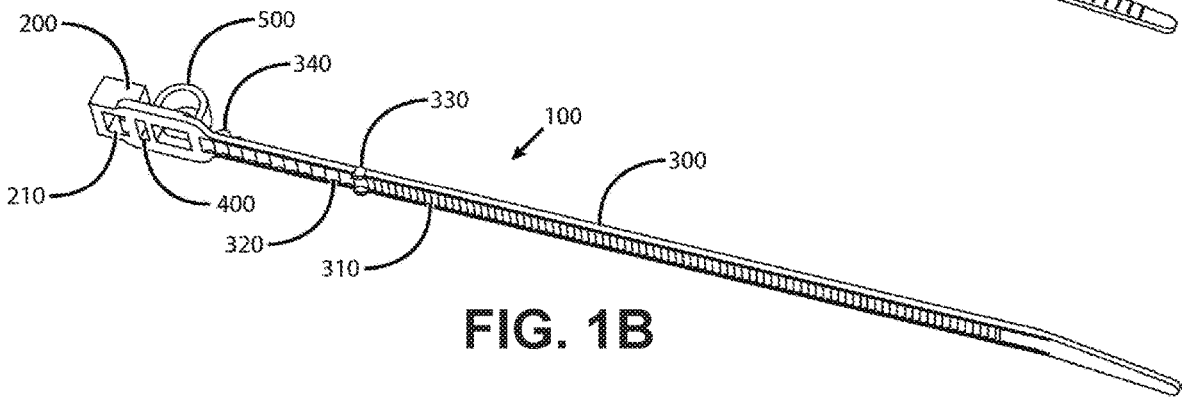
Figure 2A:
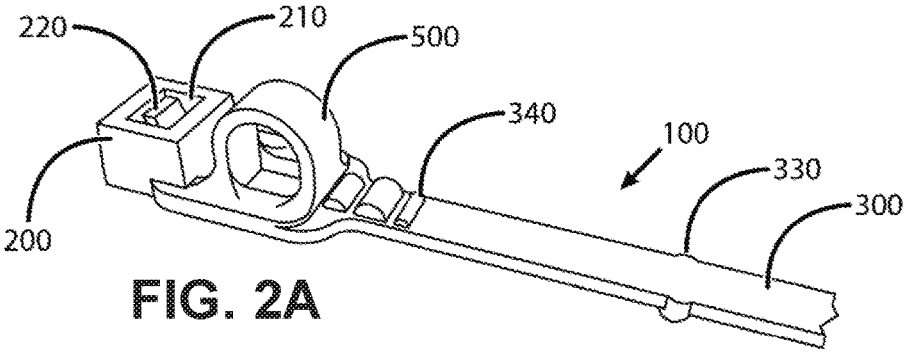
FIGS. 2A-2B show close-up top and bottom perspective views of the head, truss, and slot of the first embodiment, respectively.
Figure 2B:
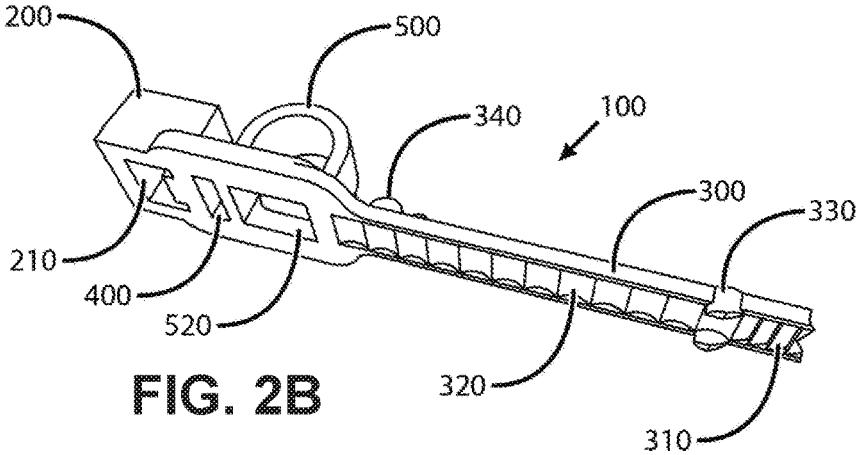
Figure 4A:
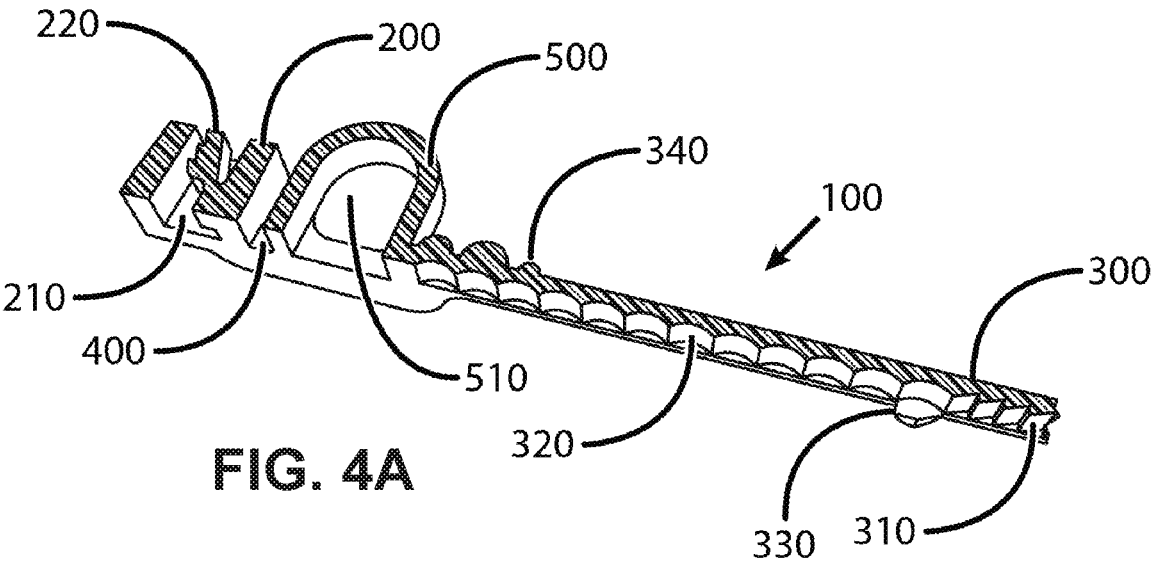
FIGS. 4A-4B show close-up top and bottom perspective views of the head, truss, and slot of the first embodiment taken along line A-A of FIG. 3B, respectively.
Figure 4B:
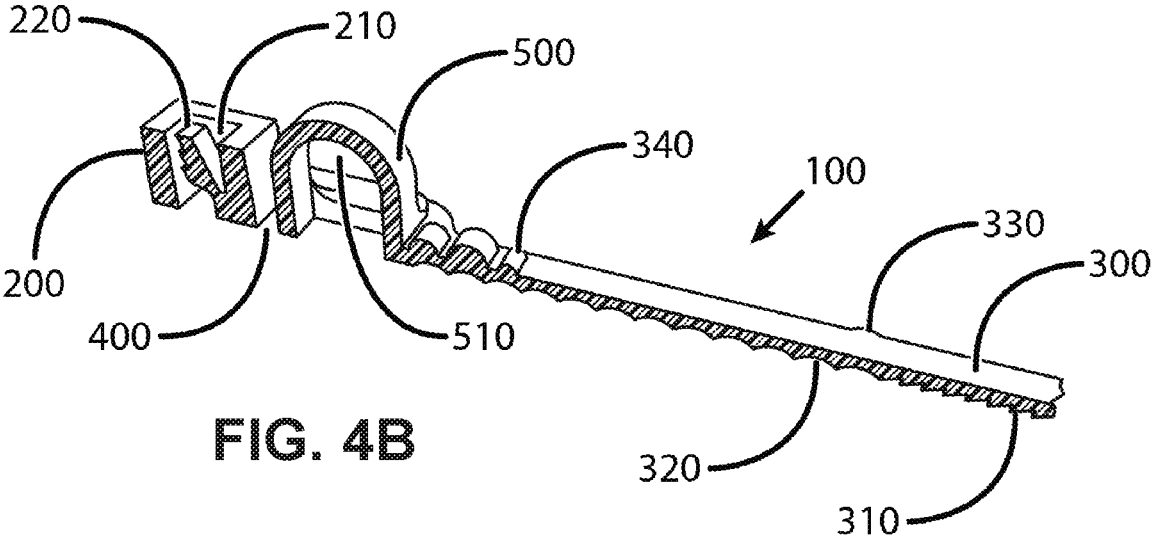

FIGS. 1A-1B show a first embodiment of the cable tie 100 comprising a head 200 and a strap 300. The head 100 includes a channel 210 adapted to receive the strap. A pawl 220 protrudes into the channel 210 for engaging the strap. The pawl 220 may be a toothed clutch and/or hinged member that mates with a region of the strap 300 having one or more serrations 310 as shown in FIGS. 4A-4B. However, the pawl 220 may be any means capable of engaging the strap 300, for example a ball that becomes wedged between a surface of the strap 100 and an angled surface of the channel 210. Consequently, the serrations 310 may or may not be present. The serrations 310 may be formed as one or more symmetric or asymmetric teeth, ribs, ridges, slots, or holes defined on, in, or through the strap 300. The serrations 310 may be on the opposite surface of the strap 300 from which the truss 500 protrudes (as illustrated in the many figures); or they may be on the same surface of the strap 300 from which the truss 500 protrudes (not illustrated); or they may be on both aforementioned surfaces of the strap 300 (not illustrated); or they may be on any plurality of any surfaces of the strap 300 (not illustrated).

Although the channel 210 is illustrated as a through-hole having an axis substantially perpendicular to the plane of the strap 300, its axis may be oriented in any relation to the plane of the strap 300, for example it may be substantially parallel to the plane of the strap 300 as is commonly the case for low-profile cable ties. Further, the channel 210 may be an open-faced (not fully enclosed) channel defined on a surface of the head 200 instead of a bore defined therethrough.

FIGS. 2A-2B and FIGS. 3A-3D show close-up perspective and elevation views of the cable tie 100, respectively. A truss 500 separates the head 200 from the strap 300. A slot 400 is disposed adjacent to the truss 500 separating the truss 500 and the head 200. The aperture of the slot 400 may be any size and shape adequate to receive the strap 300 therethrough. Sizing the slot 400 to be only slightly larger than the cross-sectional dimensions of the strap 300 may reduce play of the strap 300 within the slot 400.

Figure 6A:
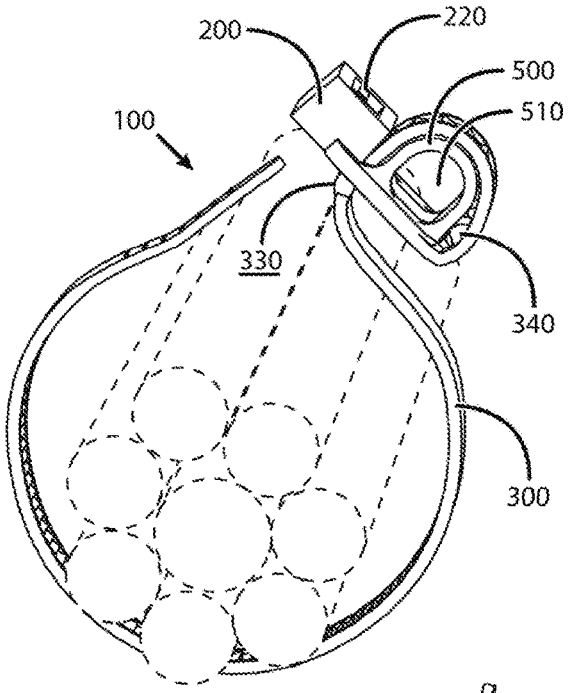
FIGS. 6A-6D show a perspective sequence of the first embodiment being secured to and cut off from a bundle of objects.
Figure 7A:
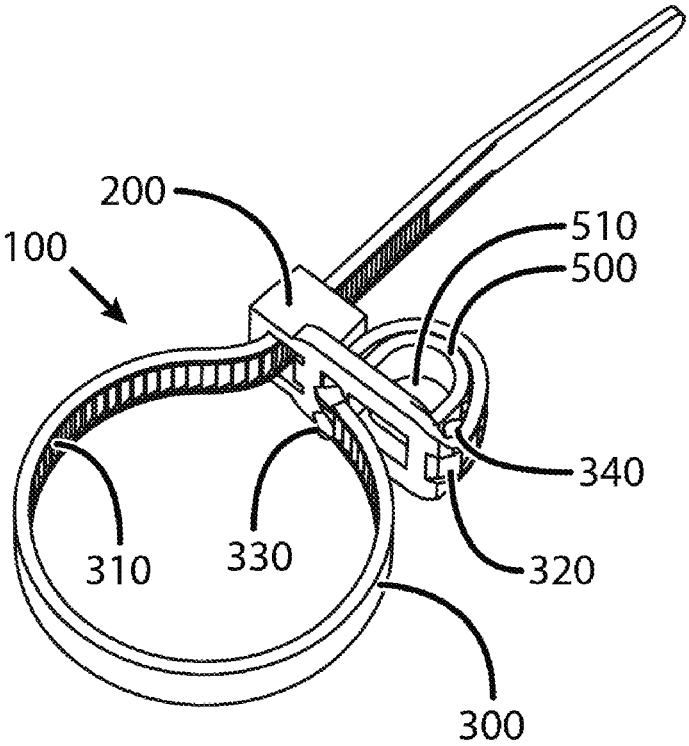
FIGS. 7A-7F show a perspective sequence of the strap of the first embodiment being cut and pulled through the slot away from the truss.
Figure 7B:
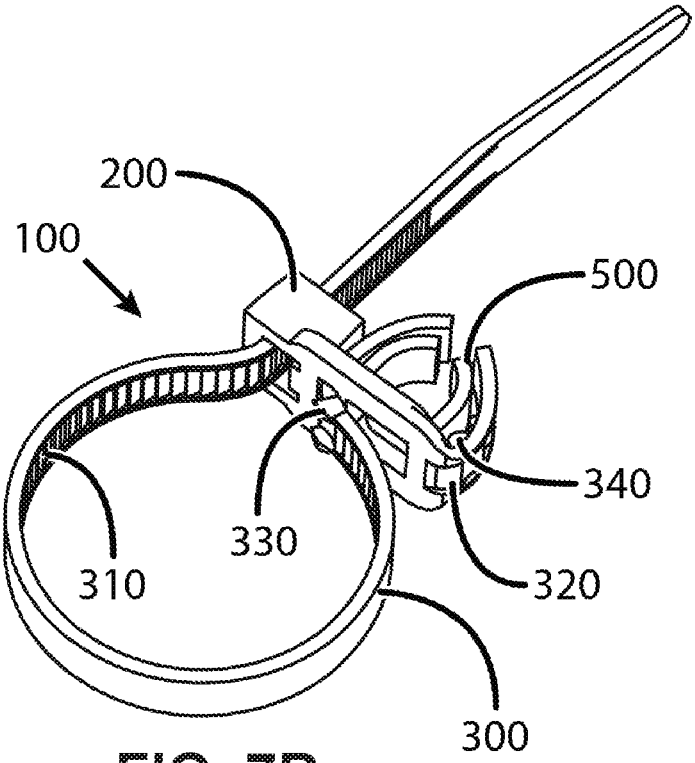
Figure 7C:
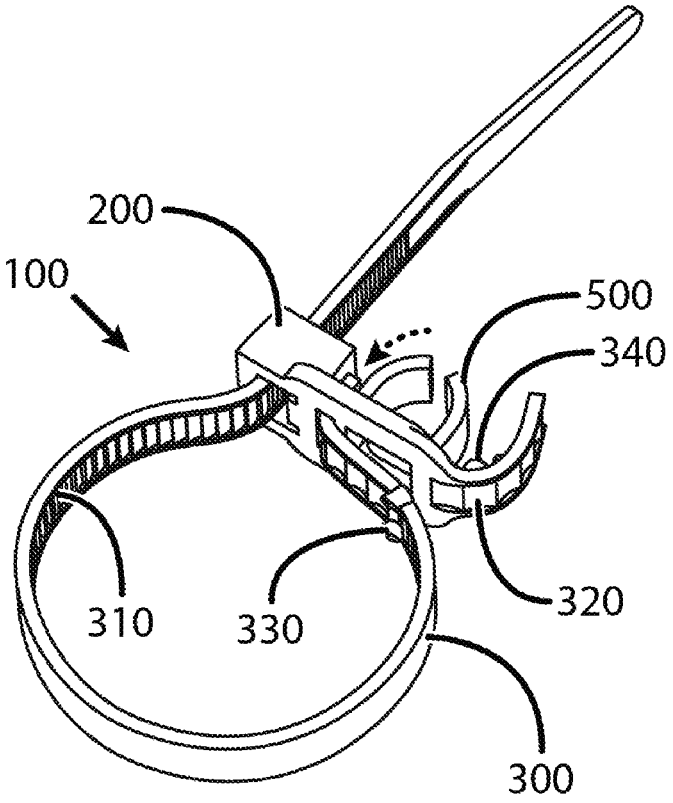
Figure 7D:
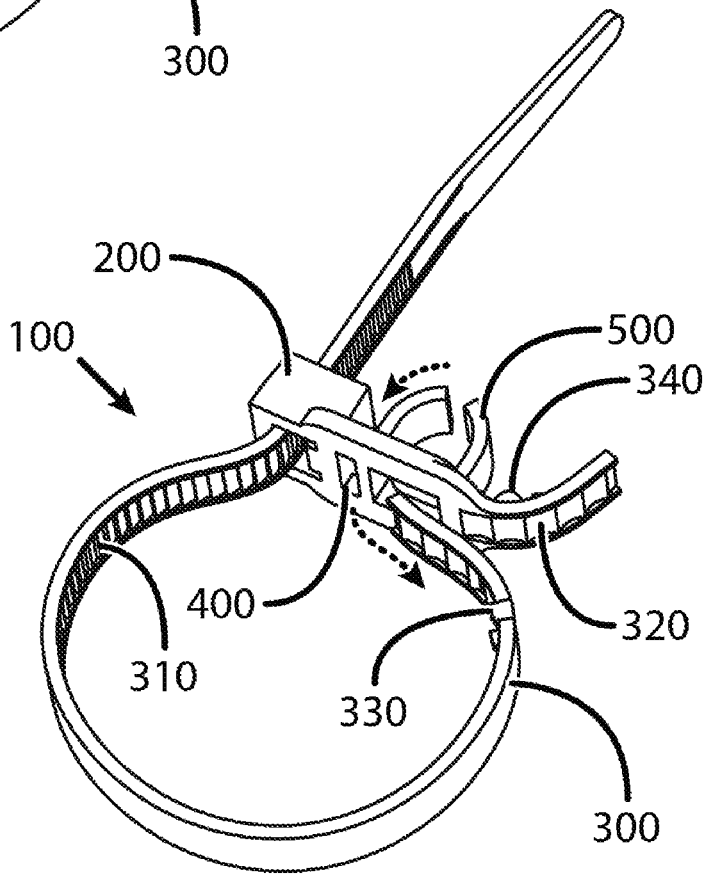
Figure 7E:
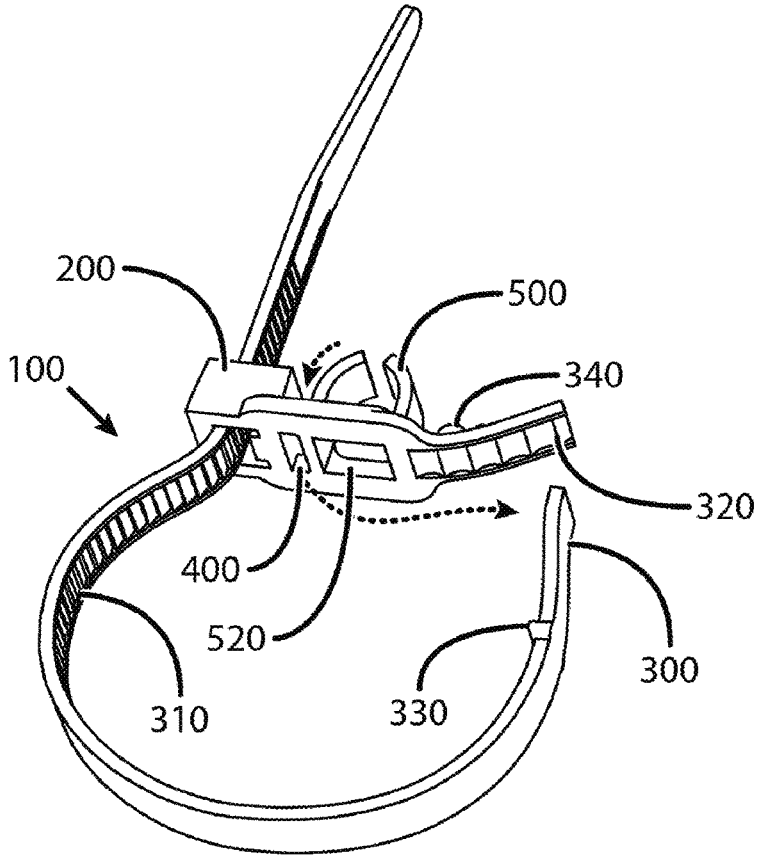
Figure 7F:
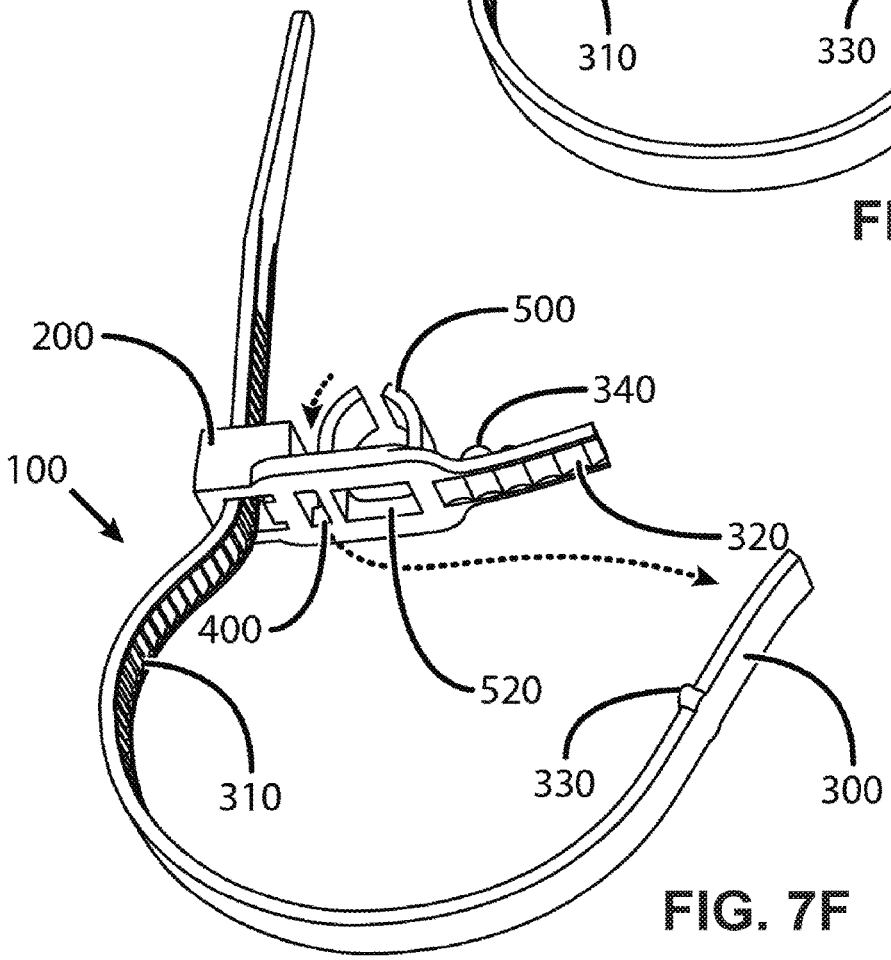

The separation between the head 200 and the truss 500 need not be approximately equal to the relevant dimension of the slot 400 as illustrated; there may be a distance between the truss 500 and the slot 400 and/or a distance between the head 200 and the slot 400. The effectiveness of the truss 500 to behave as a structural member capable of supporting a first loop of the strap 300, as shown in FIGS. 5D, 6A, and 7A, may diminish as the distance between the slot 400 and the truss 500 becomes excessively large, for example larger than approximately the height of an apex of the truss 500. It may be beneficial for the slot 400 to be adjacent to both the head 200 and the truss 500 and for the slot to be approximately minimally dimensioned to receive the strap 300. in this case, the head 200 and the truss 500 may sandwich the strap 300 when the strap 300 is inserted within the slot 400 as shown in FIGS. 5D, 6A, and 7A. This permits the head 200 to assist the truss 500 in structurally supporting a first loop of the strap 300, for example by transfer of forces and/or by friction.

Figure 3A:
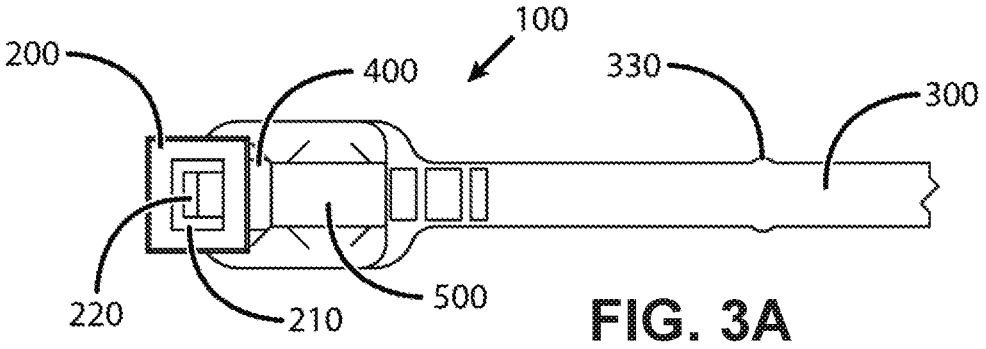
FIGS. 3A-3D show top, bottom, side, and front elevation views of the first embodiment, respectively.
Figure 3B:
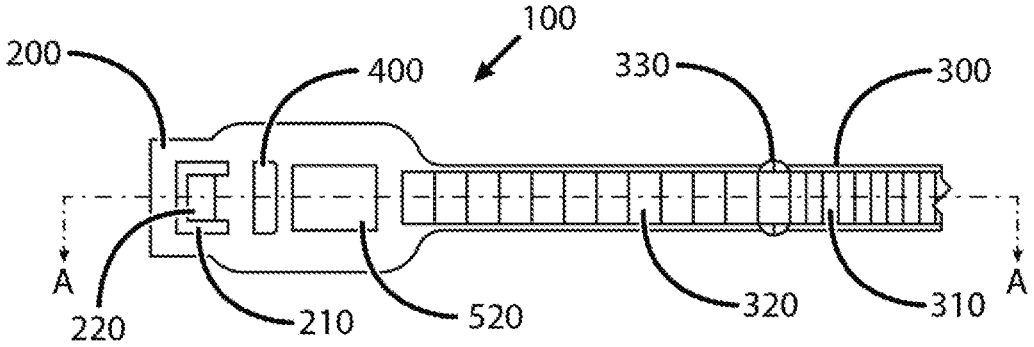
Figure 3C:
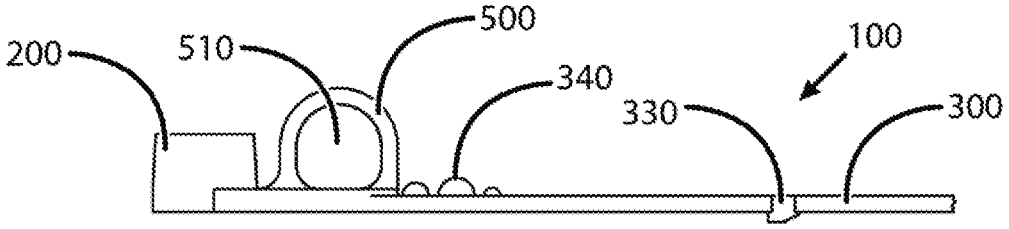
Figure 3D:
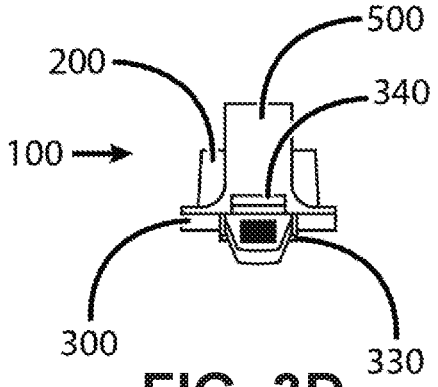

Although the truss 500 is illustrated as an arch having two footings, the truss 500 may be any member that projects from the plane of the strap 300 that has at least one footing. For example, the truss 500 may be a single projecting member (e.g., a pillar, boss, support, or post) capable of supporting a loop of the strap 300 by itself (not illustrated); or the truss 500 may be a single projecting member that supports a loop of the strap 300 with assistance from the head 200 (not illustrated); or the truss 500 may be a pair or plurality of projecting members that together are capable of supporting a loop of the strap 300 (not illustrated). The truss 500 may itself define a cavity 510, for example if the truss 500 is shaped like an arch as shown in FIG. 3C. However, if the truss 500 is a single projecting member, the cavity 510 may be formed by the bending action of the strap 300 as it rests upon the truss 500, or the cavity 510 may be formed by the truss 500 in conjunction with any other element or surface of the cable tie 100.

FIGS. 5A-5D show a sequence of the strap 300 passing over an apex of the truss 500 and being inserted into the slot 400, thereby creating a first loop. The first loop may be called a "closed" loop because it contributes to forming, or enclosing, a cavity 510 therein. A closed loop need not consist of the strap 300 completely circumscribing the cavity by 360 degrees. For example, in the third embodiment of FIGS. 9-11, the strap may form a first loop by overlapping the head even though the strap may not completely circumscribe the cavity therein.

Figure 5A:
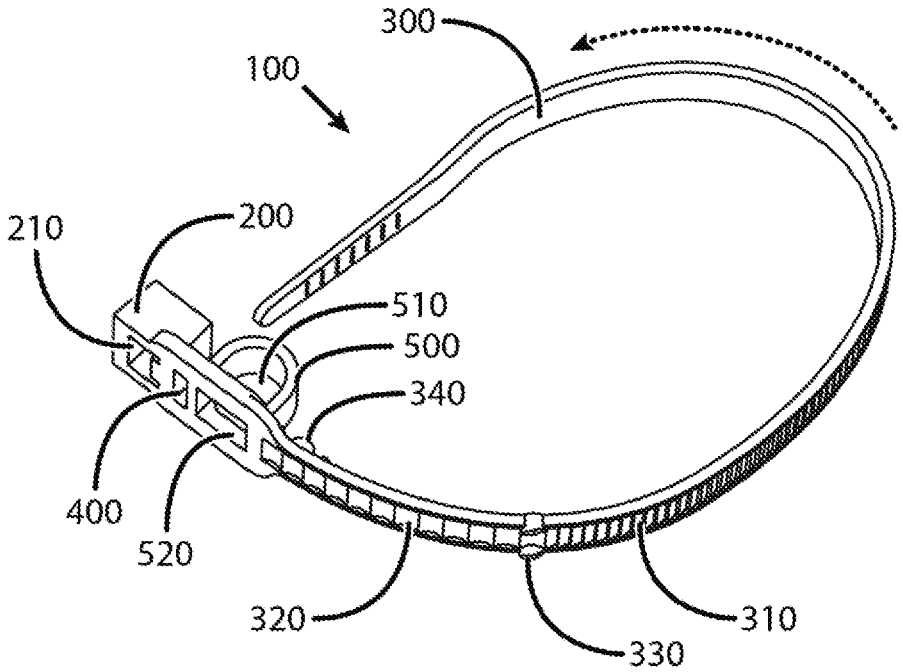
FIGS. 5A-5D show a perspective sequence of the strap of the first embodiment being inserted into the slot adjacent to the truss.
Figure 5B:
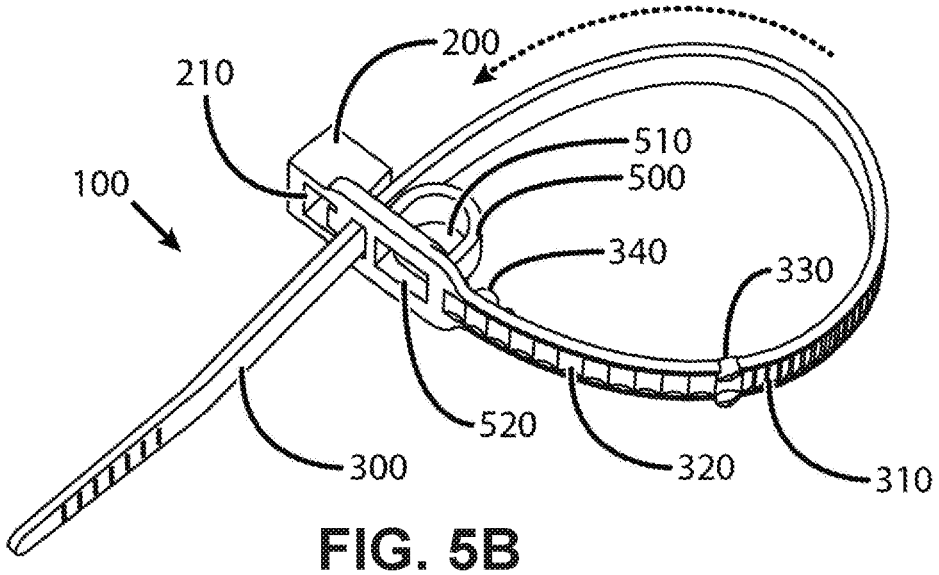
Figure 5C:
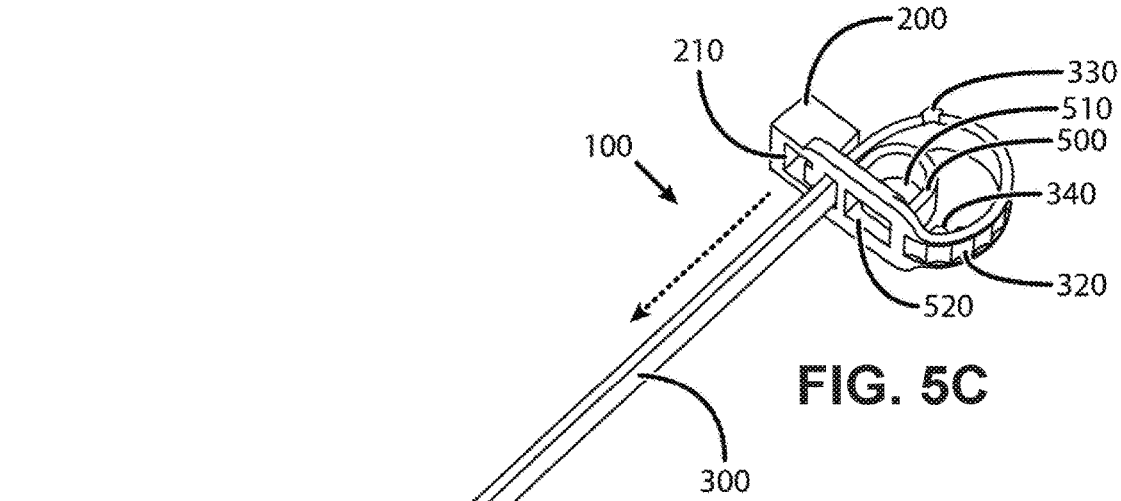
Figure 5D:
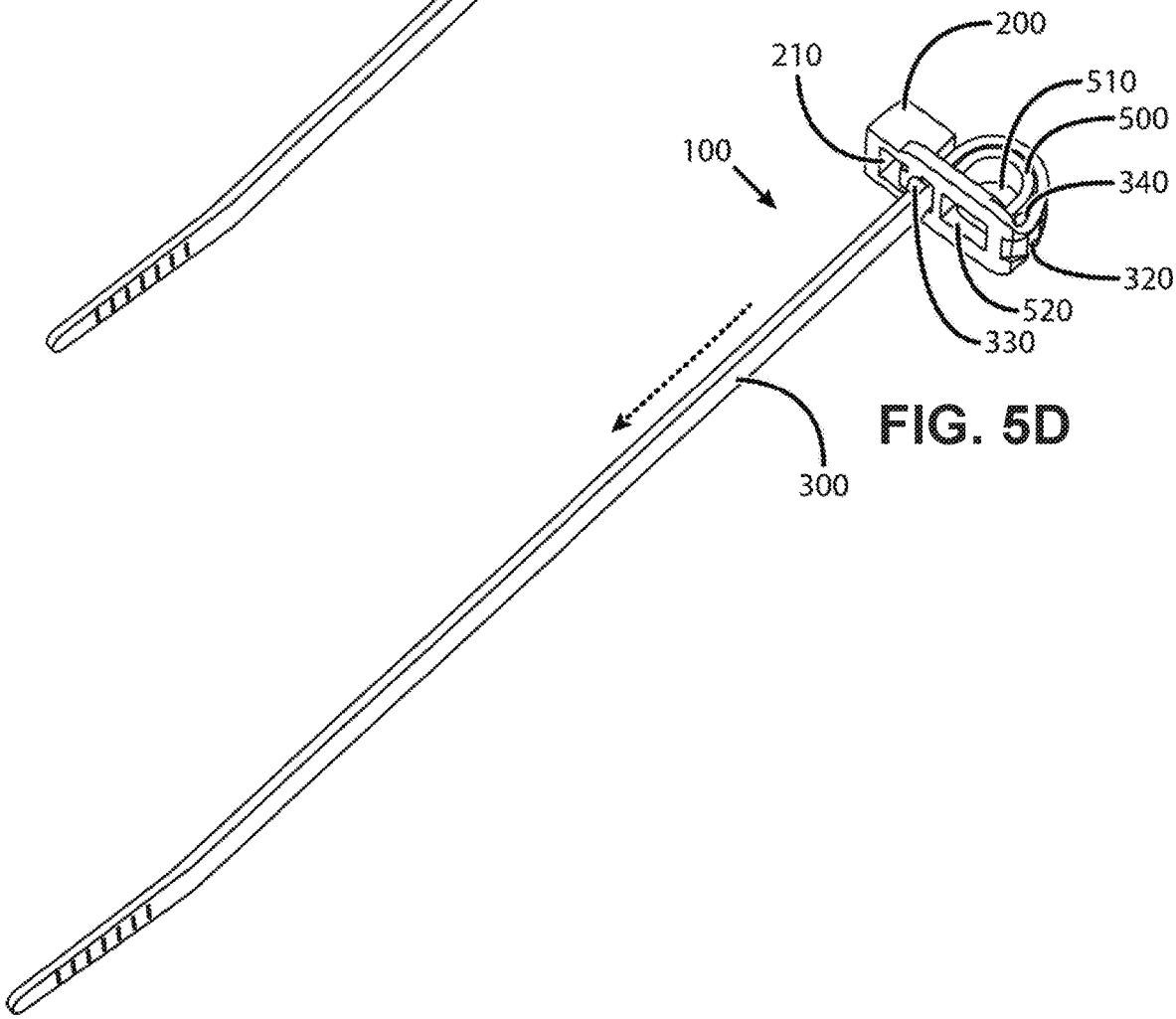

The strap 300 may resist being bent into a relatively small-radius first loop as shown in FIG. 5D, and may therefore cause the loop to rebound into a relatively larger-radius loop as shown in FIG. 5B. The strap 300 may include one or more optional bulges 330 that may retain the strap 300 in a relatively small-radius first loop by impeding withdrawal (and/or insertion) of the strap 300 from the slot 400. For example, the bulge 330 may comprise a barb or a wedge that moves through the slot 400 in the direction of insertion more easily than it moves through the slot 400 in the direction of withdrawal. Further, the bulge 330 may comprise a lip that overhangs an egress surface of the slot 400, especially an egress surface adjacent to an outside surface of the first loop. Additionally, a friction or resistance caused by the bulge 330 when a user pulls it though the slot 400 may provide tactile feedback indicating that he has successfully formed the relatively small-radius first loop.

The loop shown in FIGS. 5A-5D may be formed by a user or they may be formed by the manufacturer or reseller of the cable tie 100. If the cable tie 100 is sold as shown in FIG. 5D, then the bulge 330 may be formed onto the strap 300 after the strap 300 has been inserted into the slot 400 and the loop has been created, for example by speed-tip welding of a plastic strap 300. Additionally, the strap 300 may be maintained in the first loop as shown in FIG. 5D by any other securing means, for example by glue, by heat deformation, or by any form of welding such as ultrasonic welding or laser welding.

The cable tie 100 may include one or more optional bumpers 340 disposed on the strap 300 adjacent to the truss 500 between the truss 500 and the distal end of the strap 300. As shown by the sequence from FIG. 5C to FIG. 5D, the bumper 340 may contact surface of the truss 500 (or adjacent bumpers 340 may contact each other) when the strap 300 forms the first loop. This may reduce the sharpness of the bend of the strap 300 adjacent to the truss 500, thereby helping to prevent fracturing the strap 300 at that location.

The cable tie 100 may include one or more optional corrugations 320 disposed on a surface of the strap 300 near the truss. The corrugations 320 may be on the opposite surface of the strap 300 from which the truss 500 protrudes (as illustrated in the many figures); or they on the same surface of the strap 300 from which the truss 500 protrudes (not illustrated); or they may be on both wide surfaces of the strap 300 (not illustrated). The corrugations 320 may be disposed approximately adjacent and/or opposite a footing of the truss 500 or approximately adjacent and/or opposite the bumper 340, and may extend by a length approximately equal to the circumference of the first loop when formed as shown in FIG. 5D, 6A, and FIG. 7A. This length may also correspond to the distance between a footing of the truss 500 and the bulge 330. The corrugations 320 may reduce the stiffness of the strap 300 at or along the bend of the first loop of the strap 300, thereby helping to prevent fracturing the strap 300 at that location.

Finally, the cable tie 100 may optionally include a void 520 beneath the truss 500 to aid in manufacturing of a plastic injection-molded cable tie 100. The void 520 is not necessary if the truss 500 comprises one or more projecting members that do not have any overhangs relative to a parting line that divides the cable tie 100 into first and second portions. Further, the void 520 may not be necessary even if the truss 500 includes overhangs relative to a parting line provided the plastic-injection mold has slides or other elements that aid in the manufacture of such overhanging features.

Figure 6B:
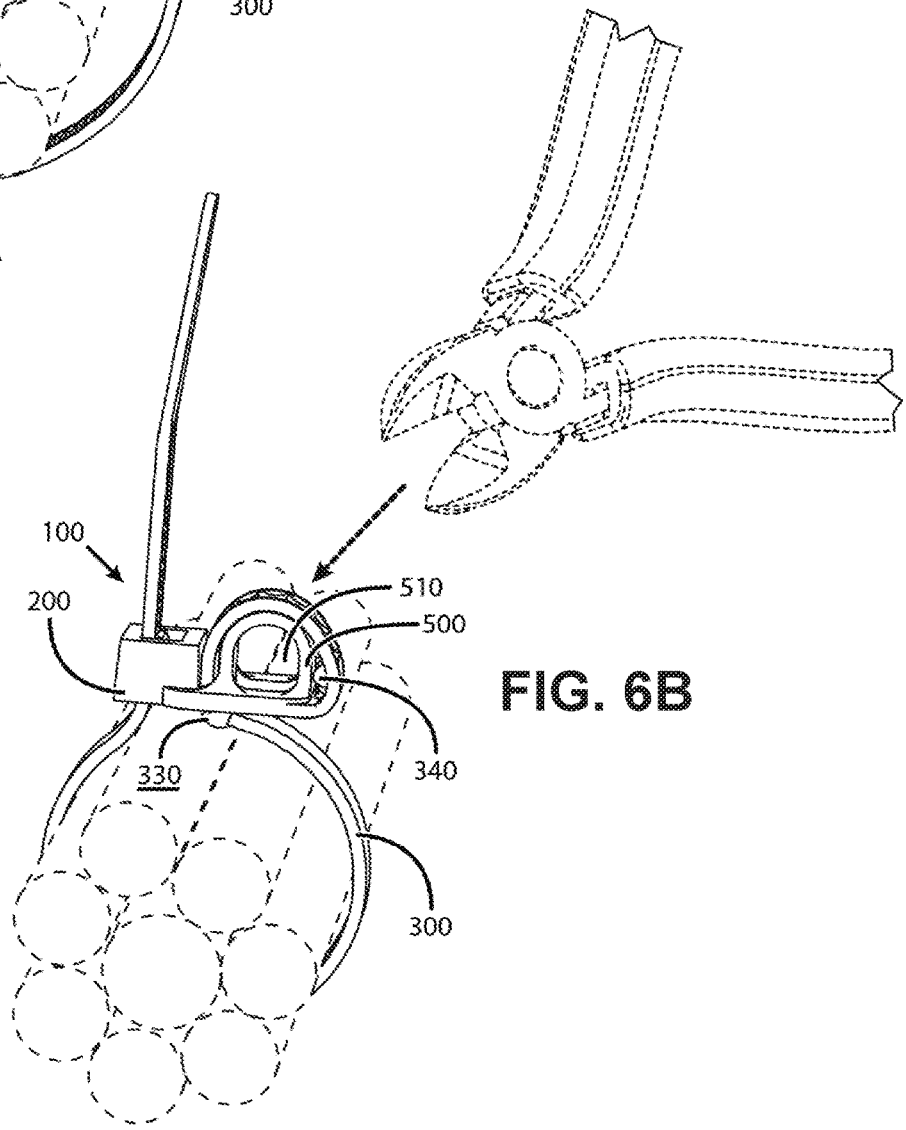
Figure 6C:
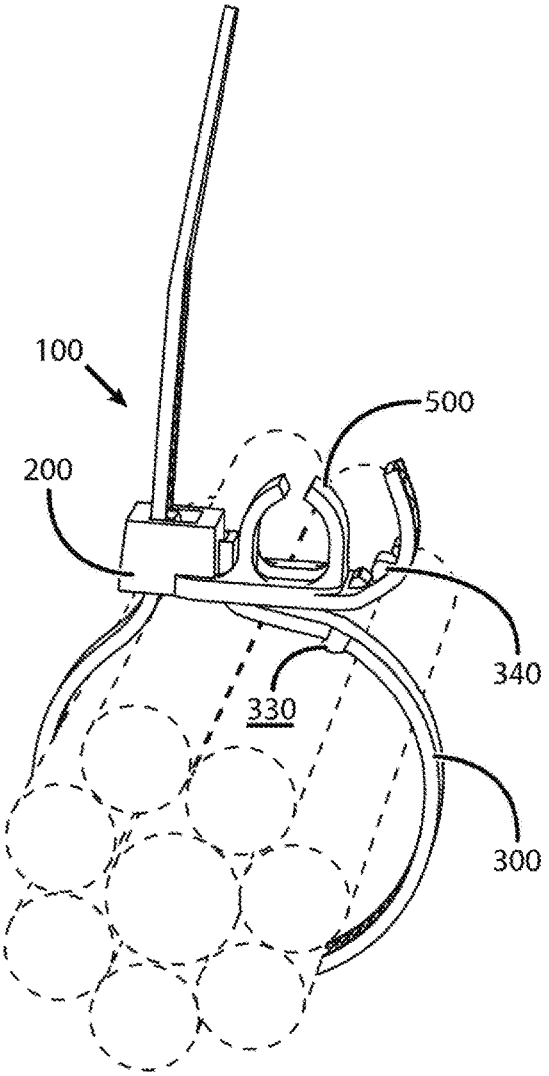

FIG. 6A shows the cable tie 100 configured as shown in FIG. 5D being secured around an object. The distal end of the strap 300 is simply passed around the object and inserted into the channel 210. FIG. 6B shows the cable tie 100 secured to the object and further shows an exemplary cutting implement whose blade may be inserted into the cavity 510. FIG. 6C show the strap 300 having been cut at a location separated from the object by some portion of the cavity 510. This cut may be at or near an apex of the truss 500 as shown or near a footing of the truss 500 (not shown).

Figure 6D:
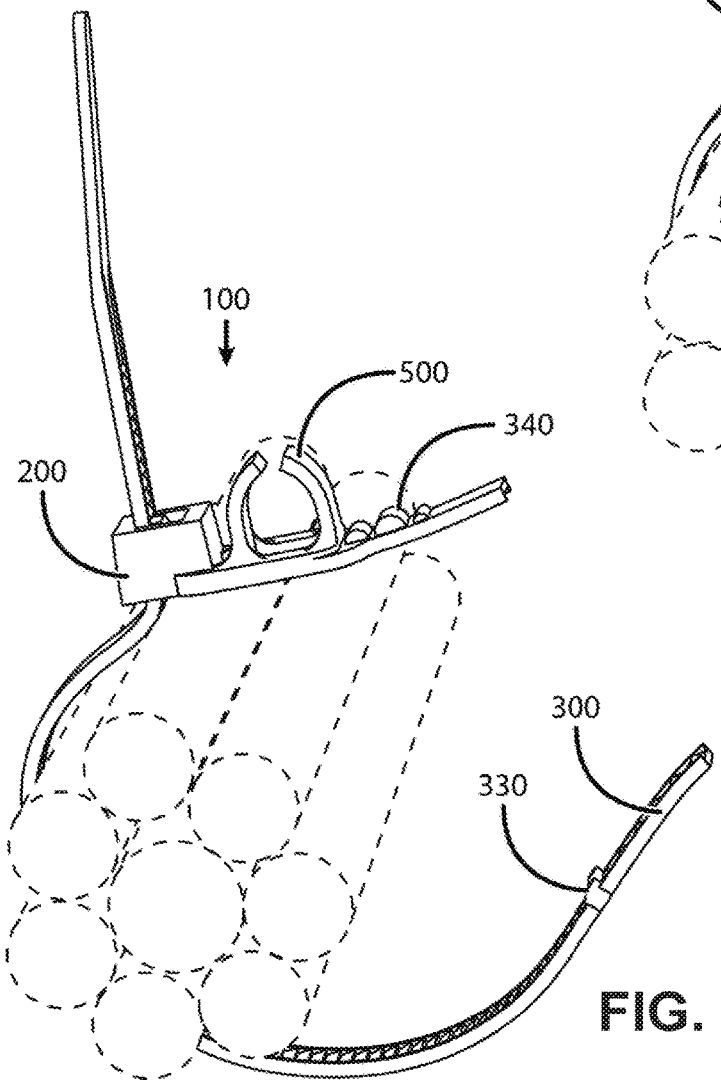

The severed strap 300 is no longer held together in tension adjacent to the truss 500, meaning the severed segments of the strap 300 may move substantially freely away from the truss 500. Consequently, the remainder of the segment of the strap 300 that surrounds the object may now pass through and out of the slot 400 and away from the object as shown in FIG. 6D.

FIGS. 7A-7F show the sequence of cutting and removing the cable tie 100 in greater detail (the object is not shown). Note that cutting of the truss 500 may be incidental and may not itself cause the cable tie 100 to separate from an object. For example, a truss 500 formed as a single projecting member may or may or may not be cut when the strap 300 is cut, depending on how the cavity 510 is created and where along the cavity the strap 300 is cut.

A typical cable tie generally has one strap and one locking head (one channel) as has been generally described and illustrated with reference to the first embodiment. However, cable ties exist that have multiple straps and multiple channels. For example, plastic zip-tie handcuffs used as restraining devices by law enforcement officers typically comprise two straps and two channels (the heads may be integrated together or separated by a distance). A cable tie may have more than two straps and more than two channels, and the number of channels need not equal the number of straps.

Figure 8A:
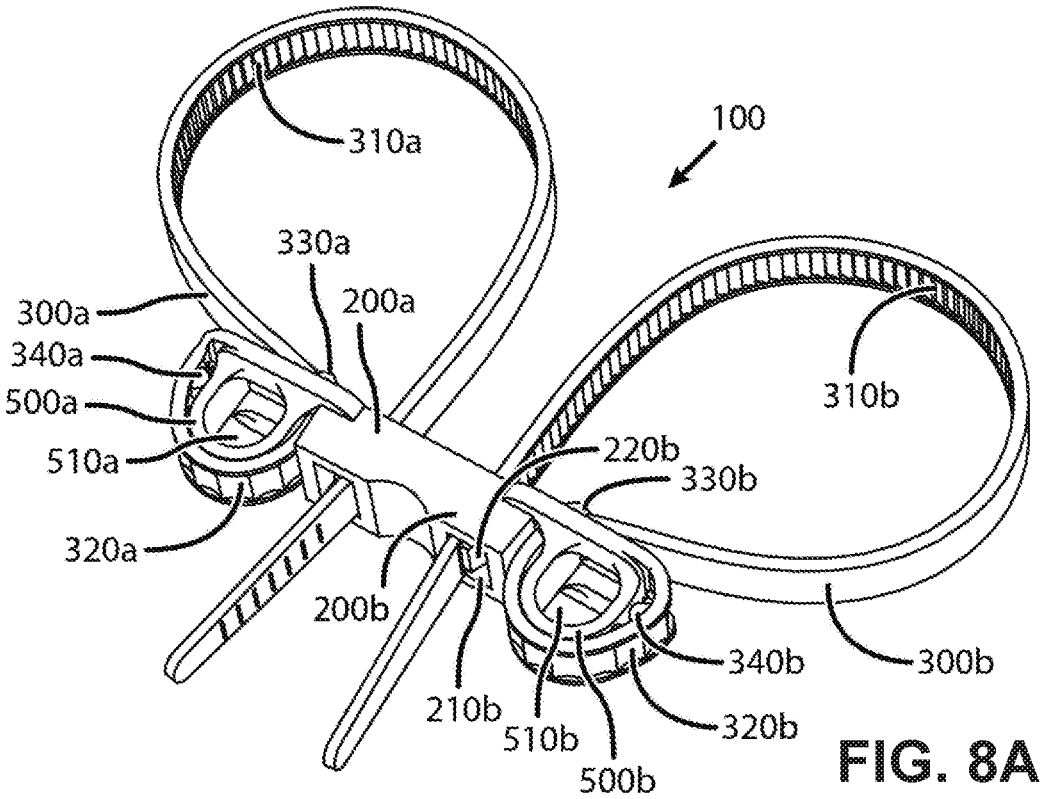
FIGS. 8A-8B show front and rear perspective views of a second embodiment, respectively.
Figure 8B:
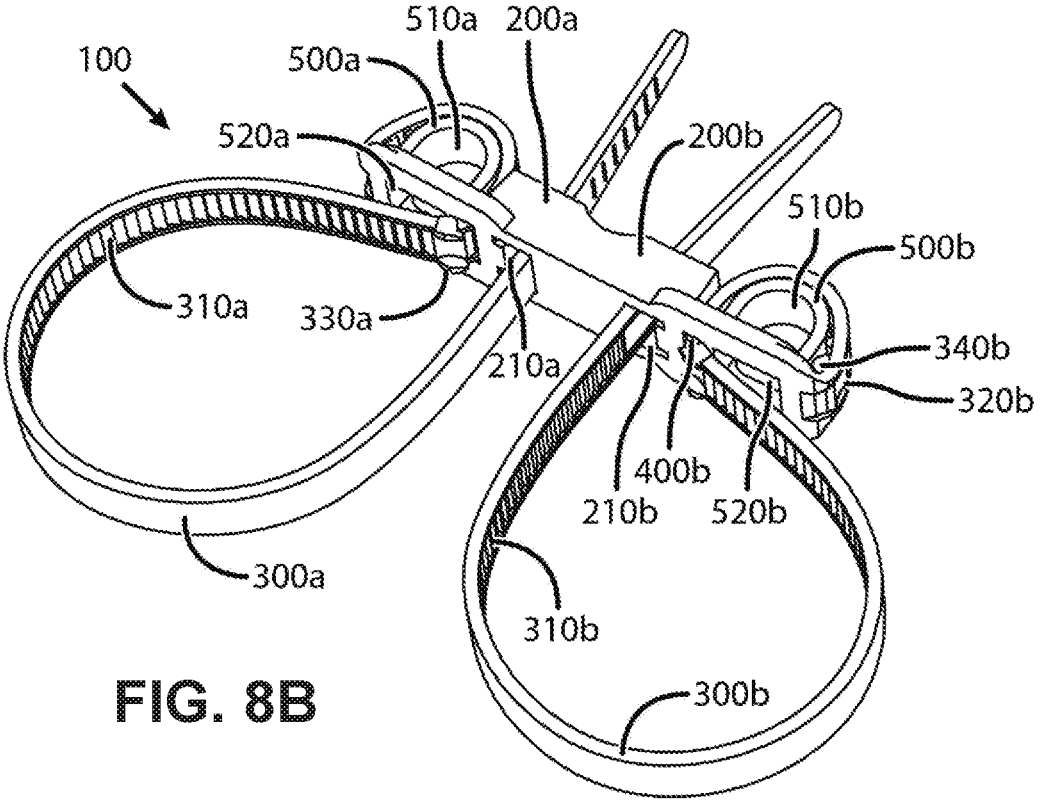

FIGS. 8A and 8B show a second embodiment of the cable tie 100 having two straps, strap 300*a* and strap 300*b*, and two heads, head 200*a* and head 200*b*. The head 200*a* and head 200*b* are joined together such that channel 210*a* and channel 210*b* are substantially parallel and each receives the strap 300*a* and strap 300*b*, respectively, in the same direction of insertion. In other embodiments (not illustrated) the heads may be joined together or joined at a distance by a flexible member, and the heads may be oriented end-to-end, side-by-side, top-to-bottom, or in any other manner that preserves the locking functionality of each strap by each head (i.e., the orientation of the channels relative to each other in three-dimensional space may be parallel, perpendicular, or arbitrary).

At the time of manufacture of the cable tie 100 of FIGS. 8A and 8B, the strap 300*a* and strap 300*b* would be substantially coplanar and they would extend approximately in opposite directions. In other embodiments (not illustrated), the orientation of the straps relative to each other in three-dimensional space at the time of manufacture may be parallel, perpendicular, or arbitrary.

Head 200*a* has a channel 210*a* and a pawl 220*a* to receive and engage the strap 300*a*, respectively. Similarly, head 200*b* has a channel 210*b* and a pawl 220*b* to receive and engage the strap 300*b*, respectively. The strap 300*a* and strap 300*b* may have serrations 310*a* and serrations 310*b* to aid the pawl 220*a* and pawl 220*b* in engaging the strap 300*a* and strap 300*b*, respectively. The strap 300*a* and strap 300*b* may have corrugations 320*a* and corrugations 320*b* to reduce bending stress when the strap 300*a* and strap 300*b* is passed over the truss 500*a* and truss 500*b* and fed through the slot 400*a* and slot 400*b*, respectively. The strap 300*a* and strap 300*b* may have a bulge 330*a* and bulge 330*b* to inhibit withdrawal of the strap 300*a* and strap 300*b* from the slot 400*a* and slot 400*b*, respectively. The strap 300*a* and strap 300*b* may have a bumper 340*a* and bumper 340*b* to inhibit overly sharp bending or kinking of the strap 300*a* and strap 300*b* when inserted and pulled through the slot 400*a* and slot 400*b*, respectively. A cavity 510*a* and cavity 510*b* may be formed when the strap 300*a* and strap 300*b* is passed over the truss 500*a* and truss 500*b*, fed through the slot 400*a* and slot 400*b*, and rested on or adjacent to the truss 500*a* and truss 500*b*, respectively. Finally, the cable tie 100 may optionally include a void 520*a* and void 520*b* beneath the truss 500*a* and truss 500*b*, respectively, to aid in manufacturing of a plastic injection-molded cable tie 100.

Figure 9:
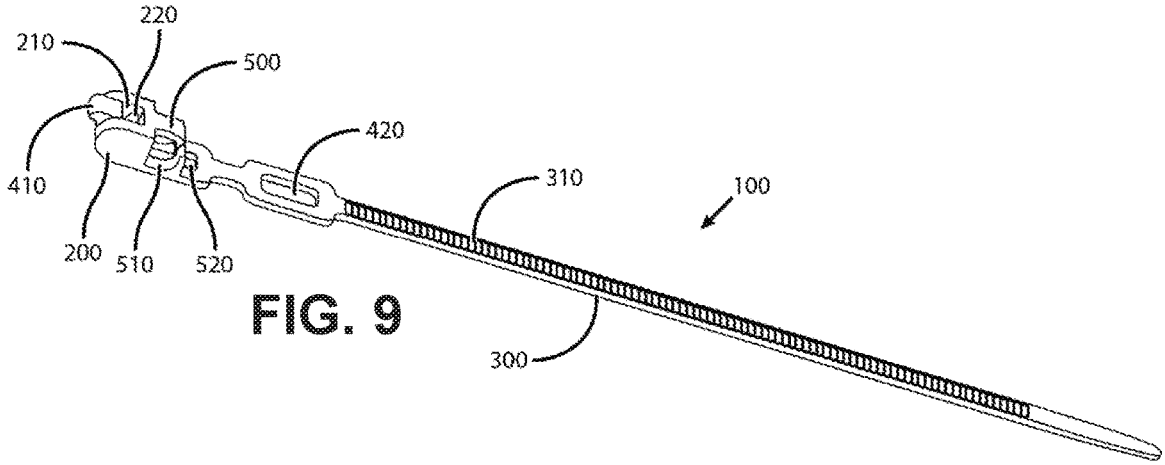
FIG. 9 shows a top perspective view of a third embodiment.
Figure 10A:
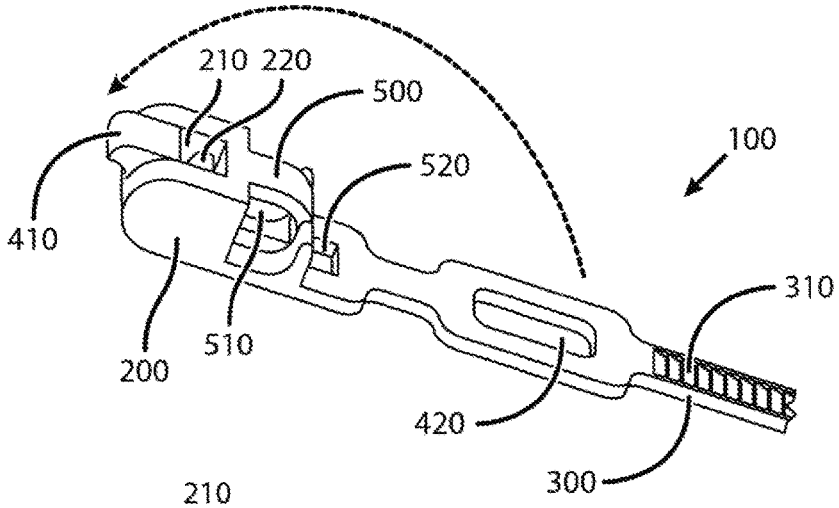
FIGS. 10A-10C show a perspective sequence of the strap of the third embodiment forming a first loop and then forming a second closed loop.
Figure 10B:
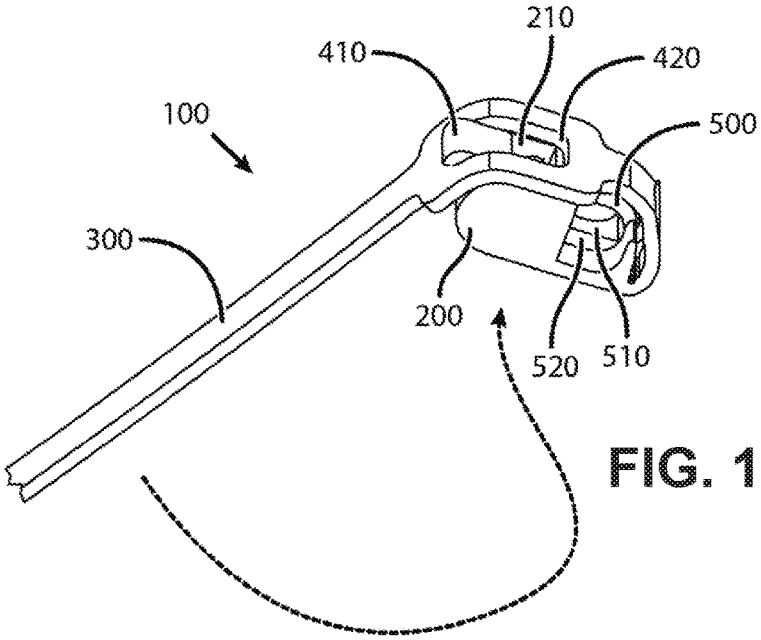
Figure 10C:
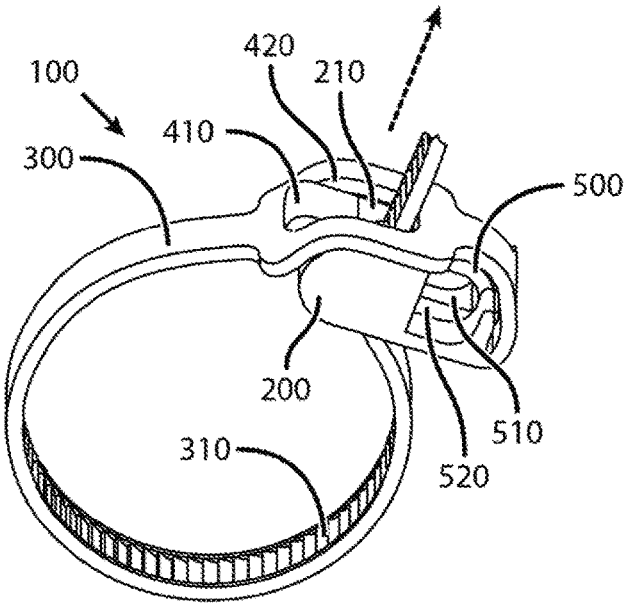

FIG. 9 shows a third embodiment of the cable tie 100 having a nub 410 that communicates with an aperture 420 to at least temporarily retain the strap 300 in a first loop formed by passing the strap 300 over the truss 500 as shown in FIGS. 10A-10C. The cable tie 100 has a head 200 having a channel 210 adapted to receive the strap 300 and a pawl 220 disposed within the channel 210 for engaging the strap 300. The cable tie 100 may optionally include a void 520 beneath the truss 500 to aid in manufacturing of a plastic injection-molded cable tie 100.

Figure 11:
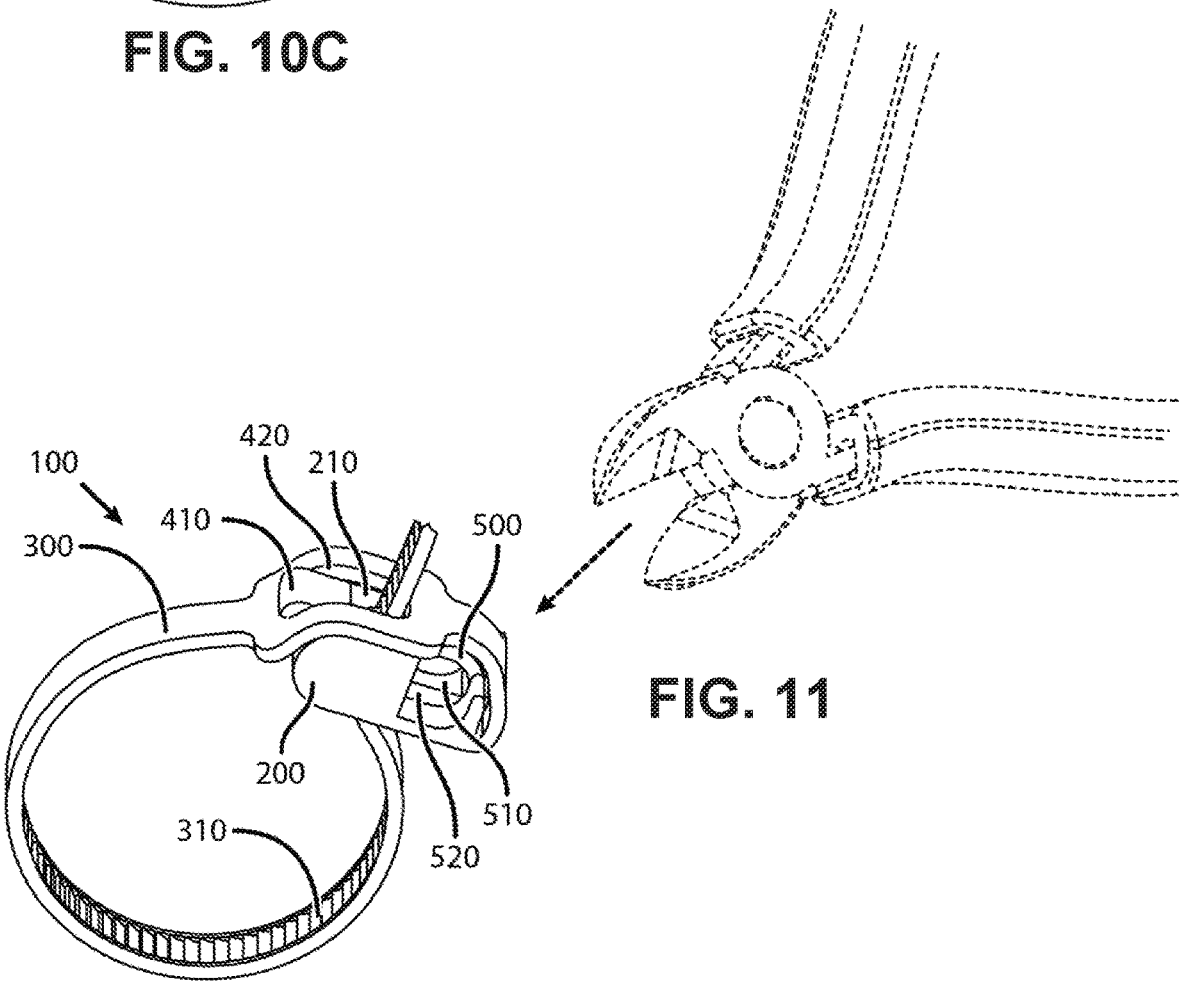
FIG. 11 shows a perspective view of the strap of the third embodiment about to be cut from an object (the object is not shown).

FIG. 10C shows how the strap 300 may pass around an object (the object is not shown) and subsequently into the channel 210 to engage with the pawl 220. FIG. 11 shows an exemplary cutting implement whose blade may be inserted into the cavity 510 formed within the first loop and whose blade may then cut the strap 300, thereby severing the first loop and permitting the strap 300 to be removed from a bundled object.

The foregoing embodiments are exemplary and should not be interpreted as limiting the scope of the present invention. Various implementations and combinations of these embodiments have been recognized and anticipated. It is therefore intended that the appended claims cover all such embodiments that do not depart from the spirit and scope of the present invention.

What is claimed is:

1. A cable tie comprising:

(a) a strap;

(b) a head formed on the strap having:

(1) a channel adapted to receive the strap, and (2) a pawl disposed within the channel capable of engaging the strap;

(c) a truss protruding out of a plane of the strap, wherein at least a portion of the strap continues in the plane of the strap in a longitudinal direction of the strap along an entire base of the truss;

(d) a slot between the head and the truss, the slot adapted to receive the strap having been passed over the truss.

2. The cable tie of claim 1 further comprising a bulge on the strap separated from the slot by the truss at a distance at least approximately twice a height of the truss, wherein a transverse cross-sectional dimension of the strap through the bulge is greater than a length or a width of the slot.

3. The cable tie of claim 1 further comprising a bumper on the plane the strap adjacent to the truss separated from the slot by the truss.

4. The cable tie of claim 1 further comprising corrugations on at least one surface of the strap separated from the slot by the truss.

5. The cable tie of claim 1 further comprising serrations on at least one surface of the strap separated from the slot by the truss and adapted to communicate with the pawl.

6. The cable tie of claim 5 wherein the truss comprises an arch having a hollow interior.

7. The cable tie of claim 5 wherein the truss comprises one or more posts.

8. The cable tie of claim 1 wherein the truss comprises an arch having a hollow interior.

9. The cable tie of claim 1 wherein the truss comprises one or more posts.

10. A cable tie comprising:

(a) a first strap;

(h) a first head formed on the first strap having:

(1) a first channel adapted to receive the first strap, and (2) a first pawl disposed within the first channel capable of engaging the first strap;

(c) a first truss protruding out of a plane of the first strap, wherein at least a portion of the first strap continues in the plane of the first strap in a longitudinal direction of the first strap along an entire base of the first truss;

(d) a first slot between the first head and the first truss, the first slot adapted to receive the first strap having been passed over the first truss;

(e) a second strap;

(f) a second head formed on the second strap approximately adjacent to the first head, having:

(1) a second channel adapted to receive the second strap, and (2) a second pawl disposed within the second channel capable of engaging the second strap;

(g) a second truss protruding out of a plane of the second strap wherein at least a portion of the second strap continues in the plane of the second strap in a longitudinal direction of the second strap along an entire base of the second truss;

(h) a second slot between the second head and the second truss, the second slot adapted to receive the second strap having been passed over the second truss.

11. The cable tie of claim 10 further comprising:

(a) a first bulge on the first strap separated from the first slot by the first truss at a distance at least approximately twice a height of the first truss, wherein a transverse cross-sectional dimension of the first strap through the first bulge is greater than a length or a width of the first slot; and (b) a second bulge on the second strap separated from the second slot by the second truss at a distance at least approximately twice a height of the second truss, wherein a transverse cross-sectional dimension of the second strap through the second bulge is greater than a length or a width of the second slot.

12. The cable tie of claim 10 further comprising:

(a) a first bumper on the plane the first strap adjacent to the first truss separated from the first slot by the first truss; and (b) a second bumper on the plane the second strap adjacent to the second truss separated from the second slot by the second truss.

13. The cable tie of claim 10 further comprising:

(a) first corrugations on at least one surface of the first strap separated from the first slot by the first truss; and (b) second corrugations on at least one surface of the second strap separated from the second slot by the second truss.

14. The cable tie of claim 10 further comprising:

(a) first serrations on at least one surface of the first strap separated from the first slot by the first truss and adapted to communicate with the first pawl; and (b) second serrations on at least one surface of the second strap separated from the second slot by the second truss and adapted to communicate with the second pawl.

15. The cable tie of claim 14 wherein:

(a) the first truss comprises an arch having a hollow interior; and (b) the second truss comprises an arch having a hollow interior.

16. The cable tie of claim 14 wherein:

(a) the first truss comprises one or more posts; and (b) the second truss comprises one or more posts.

17. The cable tie of claim 10 wherein:

(a) the first truss comprises an arch having a hollow interior; and (b) the second truss comprises an arch having a hollow interior.

18. The cable tie of claim 10 wherein:

(a) the first truss comprises one or more posts; and (b) the second truss comprises one or more posts.

19. A method of using a cable tie comprising feeding a strap having been passed over a truss projecting out of a plane of the strap into a slot disposed between the truss and a head disposed on the strap until the strap rests upon or adjacent to the tress and a cavity is thereby created beneath the strap, wherein the strap is subsequently free to pass around an object and into a channel of the head to engage with a pawl disposed therein.

20. The method of claim 19 further comprising cutting the strap with a cutting implement inserted into the cavity.

* * * * *